United States Patent [19]

Barto John A.

[11] 4,386,894

[45] Jun. 7, 1983

[54] HYBRID HIGH PRESSURE HYDRAULIC TURBINE

[76] Inventor: Barto John A., 3416 Croydon Rd., Baltimore, Md. 21207

[21] Appl. No.: 338,287

[22] Filed: Jan. 11, 1982

[51] Int. Cl.[3] ..... F03C 2/00

[52] U.S. Cl. ..... 418/215; 418/248

[58] Field of Search ..... 418/248, 210, 212, 178, 418/215, 11

[56] References Cited

U.S. PATENT DOCUMENTS

| | | | |
|---|---|---|---|
| 601,381 | 3/1898 | Piatt | 418/212 |
| 668,942 | 2/1901 | Welch | 418/11 |
| 714,424 | 11/1902 | Williams | 418/212 |
| 774,056 | 11/1904 | Estes | 418/210 |
| 970,942 | 9/1910 | Moses | 418/248 |
| 1,005,957 | 10/1911 | Girod | 418/248 |
| 1,057,900 | 4/1913 | Triggs, Jr. | 418/215 |
| 1,242,693 | 10/1917 | Hibner | 418/248 |
| 1,302,877 | 5/1919 | Sulikx | 418/248 |
| 1,335,618 | 3/1920 | Stanley | 418/248 |
| 1,770,141 | 7/1930 | Meyer | 418/248 |
| 1,827,088 | 10/1931 | Jaworowski | 418/248 |
| 2,409,141 | 10/1946 | Margolis | 418/248 |

*Primary Examiner*—John J. Vrablik
*Assistant Examiner*—Jane E. Obee
*Attorney, Agent, or Firm*—John F. McClellan, Sr.

[57] ABSTRACT

A rotary power plant that uses high-pressure, low volume hydraulic fluid has a housing journalling a rotor formed by a main shaft portion in the circumference of which one or more grooves are formed partially therearound; if more than one they are phased for partial overlap. Forming an expansion chamber with each groove, in addition to the sides of the groove and a radial end of the groove and the housing is a valve plunger spring biased against the groove, in which an end of the valve plunger rises as an automatically retractable barrier. An alternative embodiment provision of different-diameter shaft portions is disclosed.

1 Claim, 6 Drawing Figures

HYBRID HIGH PRESSURE HYDRAULIC TURBINE

FIELD OF THE INVENTION

This invention relates generally to rotary engines and specifically to a high pressure hydraulic turbine.

BACKGROUND OF THE INVENTION

Although turbines are conventionally thought about as actuated by the reaction or impulse or both of a current of fluid subject to pressure, implying relatively high-volume, high-velocity, relatively low-pressure fluid, motor means having characteristics of a turbine but in a sense a hybrid with one or more expansion chambers actuated by low volume, low-velocity, high pressure fluid may also fill a useful set of functions in specialized applications. I have disclosed a suitable reciprocating power source supplying at very high pressure a low-velocity low volume flow and using at least in part relatively unexploited naturally-occuring sources of energy.

OBJECTS OF THE INVENTION

A principal object of this invention therefore is to provide a hydraulic turbine system employing high pressure, low velocity, low volume fluid flow for the useful realization of power from sources of the type described, and similar sources.

Further objects are to provide a system as described which requires few moving parts, is simple and economical to fabricate and to operate and maintain, and which is light in weight, safe and reliable.

Still further objects are to provide a system as described which is versatile in being adaptable to provide power from one or more turbine races, as desired, in one compact turbine unit, and which is adaptable without other change for embodiments in small and large sizes.

Yet further objects are to provide a system as described which is easily and instantly controllable, which provides a low-pressure exhaust, which provides a conventional rotating shaft power-take-off, which can be used in any orientation.

BRIEF SUMMARY OF THE INVENTION

In brief summary given as cursive description only and not as limitation, the invention includes a housing with a rotatable main shaft journalled therein, the main shaft having at least one vanishing-groove, hydraulic fluid path partway therearound co-acting with a preferably automatically synchronized plunger type valve to define cyclically an expansion chamber with intake and exhaust of pressurized hydraulic fluid to rotate the main shaft.

BRIEF DESCRIPTION OF THE DRAWINGS

The above and other objects and advantages of this invention will become more readily apparent on examination of the following description.

DETAILED DESCRIPTION

Figure 1A:
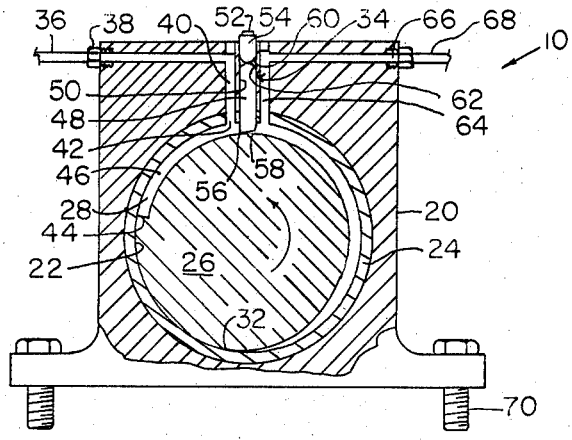
FIG. 1*a* is an end-elevational diagram partly in section.

FIG. 1*a* shows details of the invention in embodiment 10, as including a housing 20 with a circular bore 22, which may be the bore of a removable friction-fitted liner 24. The liner may be babbit or the like, journalling a first shaft portion or main shaft portion 26. Rotation of the main shaft portion is counterclockwise (arrow).

The main shaft portion 26 has a radial groove 28 around approximately 280° of the periphery intermediate the length. The cross sectional shape of the groove formed by the groove sides and bottom is "U"-shaped, deepest for the initial part 30 which extends for approximately 190° around, at which point the groove becomes shallower by tapering in depth in the direction of rotation in a preferably uniform spiral from the point of extinction 32 where it preferably merges with the cylindrical shape of the shaft between groove ends.

The following description applies to a two-groove embodiment. (For a three-groove embodiment the grooves would extend approximately 130° around and the tapered aspects would be in proportion). The taper in any case may be short (10° to 20°, for example, and tangential to the uniform portion, as a variation.

Hydraulic fluid under pressure turns the shaft by means of the groove structure and co-acting plunger valve assembly 34.

Hydraulic fluid under continuous high pressure enters through fluid intake line 36 which may connect to the housing at any conventional portal connection 38. From there it flows through fluid intake passage 40 which opens at 42 through turbine race 24, the journal liner, into groove 28 when the main shaft portion 26 is in rotational position locating the groove 28 for receiving fluid, as for example, as shown.

The radial end 44 of the groove forms a first end of an expansion chamber 46 between shaft and housing, the second end of which is formed by the valve plunger 48.

Rectangular-cross-section valve plunger 48 is biased downward in rectangular passage 50 to a tight riding-fit in the groove by spring 52 acting through plunger keeper 54 which forces first end 56 of the valve plunger, radially inward through the passage 50 against the main shaft.

The first end 56 or knife edge of the valve plunger has a bevel 58 for smoother action in riding in the groove and over the oncoming peripheral portions of the main shaft portion 26, and for better fit on the diminishing portion of the groove.

The contacting faces 60, 62 of the plunger keeper first end and valve plunger second end respectively may be convexly rounded for freer and more easily lubricated contact.

When the main shaft portion 26 has rotated around to a position where the groove radial end 44 or leading end communicates with fluid exhaust passage 64, which may be a symmetrical provision to that of the fluid intake passage on the opposite side of the plunger valve assembly 34, fluid then passes out through the fluid exhaust portal 66 and fluid exhaust line 68. Meanwhile the groove radial end 44 (which need not be exactly radial), passes the valve plunger and fluid intake opening 42 and the cycle repeats.

The housing 20 may be bolted down at 70 to any convenient support, for power take-off from the main shaft, and the main shaft portion may have more than one powering groove, fluid supply and exhaust, and plunger valve assembly, along it.

Figure 1B:
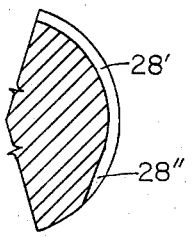
FIG. 1*b* is a fragmentary end-elevational diagram partly in section.

FIG. 1*b* shows the alternative detail mentioned above in that the groove 28' extinguishes in a short, tangential terminus 28''.

Figure 2:
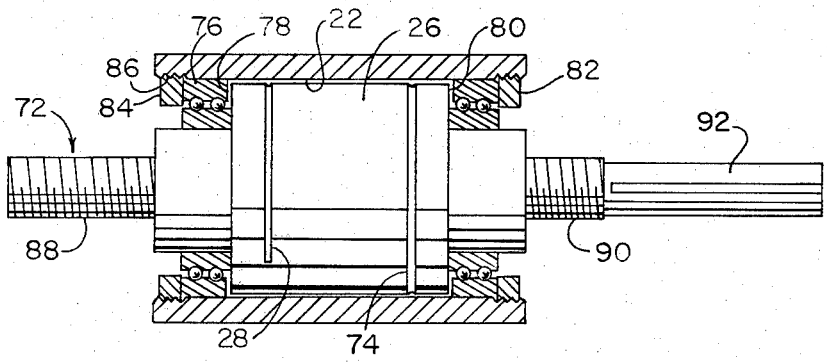
FIG. 2 is a longitudinal, partly sectional diagram of the shaft and housing shown partially in the first Figure.

FIG. 2 shows assembly relations of shaft 72 and housing 20 and the groove or grooves.

Shaft main portion 26 may have two grooves 28, 74, (or more). The second groove 74 is like the first but may be 180° out of phase with the first groove 28 so that the power strokes overlap each other for smooth power flow. With three grooves the phase relation might be 120° groove-to-groove etc.

For conventional bearing journalling, as for combination radial and thrust load anti-friction bearings 76, a reduced-diameter shoulder 78, 80 may be provided on the shaft 72 at each end of the housing uniform cylindrical bore 22, which may have a fixed bearing retainer annular flange 82 at one end and a corresponding ring 84 threaded to the housing at 86 at the opposite end.

The shaft 72 may have also a reduced-diameter portion 88, 90 at each end for other bearing arrangements for power take-off or flywheel provisions and these portions may be threaded. Keyed shaft extension 92 also facilitates conventional power take-off connection at one end.

Figure 3:
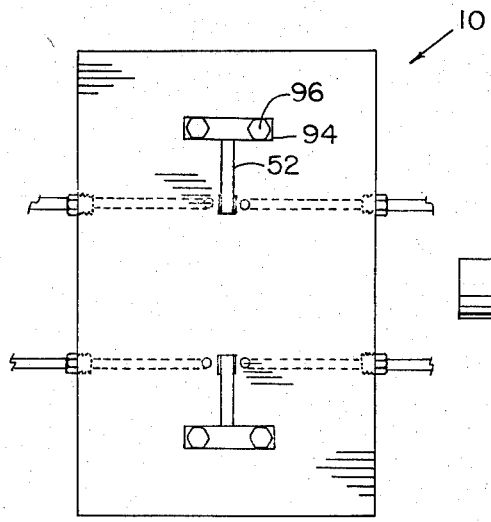
FIG. 3 is a top plan view.

FIG. 3 is a top plan diagram of the invention 10 showing details of the flat leaf-type springs 52 and the securing blocks or brackets 94 which hold down one end by means of machine screws 96, forcing the plunger keepers down against the valve plungers as previously indicated.

Figure 4:
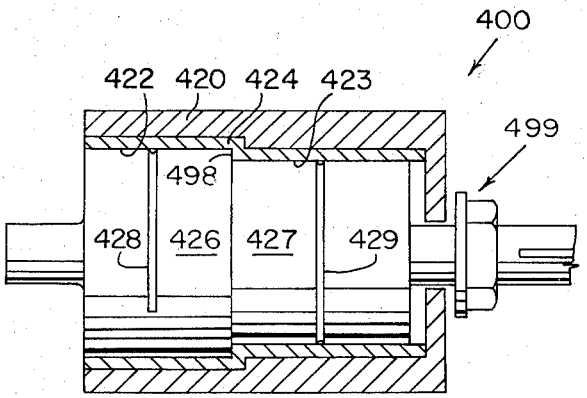
FIG. 4 is a partially sectional detail of an alternative embodiment provision.

FIG. 4 diagrams an alternative embodiment 400 provision in that housing 420 has a first bore 422 coaxial with a second bore 423 smaller in diameter. The step 498 between the bores may be lined with babbit 424 (as well as the remainder of the bore portions) so that the step 498 acts as an integral thrust bearing.

Versatility is indicated in that grooves 428, 429 may be supplied on different-diameter portions 426, 427 of the main shaft, and phasing and other principles can be the same as previously described.

If desired, any conventional retainer or guard such as nut and washer 499, or an anti-friction bearing may be used at the end to maintain the parts in assembly.

Figure 5:
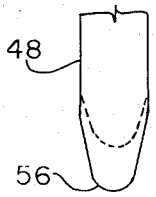
FIG. 5 is a front perspective fragmentary detail of a plunger.

FIG. 5 shows the preferred form of the knife edge 56 of plunger 48, symmetrically rounded in front and fitting the grooves. This provides for even wearing and constant seal.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for developing rotary power from pressurized liquid in an engine having a direction of rotation, a housing, a shaft portion with a cylindrical periphery journalled in a bore in the housing, means for forming at least one expansion chamber between the shaft portion and the housing said means for forming including: a plunger valve assembly, a valve plunger and biasing means being part of said plunger valve assembly; a fluid inlet adjacent a first side of said plunger valve assembly and a fluid exhaust adjacent a second side of said plunger valve assembly; including: said means for forming, forming at least one expansion chamber including said shaft portion defining a first groove extending partway around the circumference of a first portion of said shaft portion, a first end of said valve plunger engaging said first groove under said bias, said fluid inlet and said fluid exhaust located for cyclically connecting with said first groove, and said first groove tapering in depth in the direction of said rotation from a point of extinction to a uniform depth portion, the improvement comprising: said shaft portion being an integral part of said shaft, said first groove merging with said shaft portion cylindrical periphery at said point of extinction, said shaft portion defining at least a second substantially identical one of said grooves thereon in axially spaced relation from said first groove, a second said plunger valve assembly for said second groove, said shaft portion having equal diameter at each of said first and second grooves, said first and second grooves in end view partially overlapping around said shaft portion, each said groove having a rounded cross-section, each said valve plunger having a rectangular cross-section, said housing having a rectangular cross-section passage therein holding each said valve plunger, said first end of each valve plunger having a bevel, said bevel defining a knife edge at said first end of each of said plungers for fitting a said groove rounded cross-section, a respective plunger keeper for forcing each said plunger into a respective groove under said bias, each valve plunger having a convex second end and the plunger keeper having a convex first end contacting said convex second end, said bias being a spring bias acting on a second end of said plunger keeper, each said knife edge including a front end, said front end being rounded.

* * * * *